US007357278B2

(12) United States Patent
Mira Navarro

(10) Patent No.: US 7,357,278 B2
(45) Date of Patent: Apr. 15, 2008

(54) METERING VALVE FOR FLUID SUBSTANCES

(75) Inventor: Miguel Angel Mira Navarro, Alicante (ES)

(73) Assignee: Pecoso, S.L., Alicante (ES)

( * ) Notice: Subject to any disclaimer, the term of this patent is extended or adjusted under 35 U.S.C. 154(b) by 491 days.

(21) Appl. No.: 10/996,334

(22) Filed: Nov. 23, 2004

(65) Prior Publication Data

US 2005/0279771 A1 Dec. 22, 2005

Related U.S. Application Data

(63) Continuation of application No. PCT/ES03/00230, filed on May 21, 2003.

(30) Foreign Application Priority Data

May 27, 2002 (ES) ..... 200201207
May 5, 2003 (ES) ..... P200301001

(51) Int. Cl.
*B00B 5/00* (2006.01)
*B65D 88/054* (2006.01)

(52) U.S. Cl. ..... 222/153.04; 222/153.13; 222/321.2; 222/321.8

(58) Field of Classification Search ..... 222/82, 222/83, 153.04, 153.06, 153.13, 321.2, 321.8, 222/321.9, 541.2
See application file for complete search history.

(56) References Cited

U.S. PATENT DOCUMENTS 4,196,828 A 4/1980 Basile et al.
4,762,475 A 8/1988 Fuchs
5,509,578 A * 4/1996 Livingstone ..... 222/82
5,590,815 A * 1/1997 Montaner et al. ..... 222/82
5,615,806 A * 4/1997 Grothoff ..... 222/153.13
6,045,008 A * 4/2000 Gonzalez Fernandez et al. 222/153.13

FOREIGN PATENT DOCUMENTS

EP 0 389 688 A2 10/1990
EP 0 544 549 A1 6/1993
EP 0 547 439 A1 6/1993
ES 2 083 362 T3 4/1996

* cited by examiner

*Primary Examiner*—Kevin Shaver
*Assistant Examiner*—Melvin A. Cartagena
(74) *Attorney, Agent, or Firm*—Darby & Darby P.C.

(57) ABSTRACT

The valve comprises three parts of generally cylindrical shape, of two or more diameters, fitted into one another, the first of these having a structure of two successive cylinders, being fixed between the cap of the container carrying the substance to be metered and the rim of the neck of the container itself, while the second part is intended to act as main plunger, sliding by its upper portion inside the first part and having a terminal end of smaller diameter guided in the portion of smaller diameter of the first part and having in its intermediate region a likewise intermediate diameter with the main filling and discharge vents for the product, and the third part is formed by a hollow rod rigidly connected to the handle/outlet nozzle and which likewise has a cylindrical structure with two successive different diameters.

11 Claims, 9 Drawing Sheets

METERING VALVE FOR FLUID SUBSTANCES

CROSS REFERENCE TO PRIOR APPLICATION

This application is a continuation of copending International Application No. PCT/ES03/00230, filed May 21, 2003 and claims benefit of Spanish Application No. 200201207, filed May 27, 2002 and Application No. P200301001, filed May 5, 2003 which is incorporated by reference herein. The International Application was published in Spanish on Dec. 4, 2003 as WO 03/099451 A1 under PCT Article 21(2).

SPECIFICATION

The present invention relates to a metering valve for fluid substances, both liquid and paste-like, which provides substantial characteristics of novelty and of inventive step.

The valve of the present invention will be especially applicable to the cosmetic field for metering paste-like or liquid products in individual doses, corresponding to the type of devices which comprise a handle/nozzle, for actuation by compression, which at the same time serves as an outlet nozzle for the product, being connected to a hollow rod which penetrates inside the container carrying the substance to be metered and which has an action combined with a system of plungers and valves which, during the downward movement of the handle and rod rigidly connected therewith, enable a dose of the product to be expelled along said hollow rod and the internal duct of the handle/nozzle mentioned above, and during the recovery movement, which is produced automatically by means of a resilient member in the form of a spring, bellows or other form, allow the filling by suction from the inside of the container of an internal chamber which will be ready for a subsequent actuation cycle.

Although some devices of this type are known, these have certain drawbacks owing to the relative complexity of the parts necessary to perform their function, for which reason the inventors have proposed to improve the current state of the art in order to obtain a much simpler device with smooth and reliable operation.

As a result of the experiments and tests carried out by the inventors, the latter have succeeded in developing a new type of valve with built-in pump which has operating characteristics providing great reliability and smoothness of operation and which is very simple, from the point of view of its construction, thereby reducing the costs of manufacture and assembly of the device.

In addition, the device of the present invention provides safety sealing characteristics which provide a guarantee of integrity of the device and, therefore, of the container of the product which it is wished to meter.

Basically, the valve with pump assembly of the present invention consists of three parts of generally cylindrical shape, of two or more diameters, fitted into one another, the first of these having a structure of two successive cylinders which is fixed between the cap of the container carrying the substance to be metered and the rim of the neck of the container itself, while the second part is intended to act as the main plunger, sliding with its upper portion inside the first part and having a terminal end of smaller diameter guided in the portion of smaller diameter of the first part, and having in its intermediate region a likewise intermediate diameter with the main vents for the filling and discharge of the product, and the third part is formed by a hollow rod rigidly connected to the handle/outlet nozzle and which likewise has a cylindrical structure with two successive different diameters, the larger diameter, provided with peripheral abutment ribs, sliding inside the plunger portion of the second part, while the likewise cylindrical end of said third part is capable of fitting in the terminal end of smaller diameter of the second part, further having a projection in the shape of an intermediate ring capable of establishing an abutment in a complementary region of the second part. Said third part has a transverse partition wall which separates the hollow enclosure of the upper portion, communicating with the outlet nozzle, with respect to the terminal end capable of fitting into the narrower portion of the second part. Said third part has above the said intermediate partition wall vents for communication of an intermediate chamber receiving the product to be metered, and formed principally by the inner walls of the first tubular part, with the upper portion of the hollow rod which communicates with the outlet nozzle.

The upper and lower axial abutment positions of the second part, which carries the body of the main plunger, are established respectively by an internal projection of the closure cap of the container carrying the product to be metered, and an internal spring of the first part of the device, which forms the lower displacement abutment when the body of the plunger impinges thereon.

The upper and lower displacement abutments of the hollow tubular member of the third part are formed by respective peripheral ribs which slide inside a tubular region of the second part which has upper and lower projections, respectively, for determining the axial displacement positions of said third part.

The terminal end of the second part is arranged so as to abut on a small partition wall which constitutes a safety seal for the device, provided on the second part at the entrance of the cylindrical region of smaller diameter, such that on the initial use of the device, a first axial thrust on the metering handle/nozzle will result in the breakage of said seal, which breakage is perceptible by the user and constitutes a guarantee that the device, and therefore the container, have not been used previously.

The assembly formed by the metering handle/nozzle and hollow rod which forms the third cylindrical part mentioned previously receives the opposing action of a spring or bellows which, once a compression/metering cycle has been completed, returns said assembly to the upper abutment position, which likewise includes a product suction cycle which fills the intermediate chamber of the device.

The present invention likewise, in a preferred version, provides that the valve cannot be actuated unintentionally and that after each cycle of use it returns to an abutment position in which the axial actuation which could have the effect of discharge of the product cannot occur.

To this end, the present invention provides for the arrangement of an assembly of combined helical ramps, disposed, on the one hand, in the hollow rod displaceable by the actuation of the valve and, on the other hand, in a part of the cap coupled to the container which receives inside it, so as to slide, the piston associated with said hollow rod. Said helical ramps of the rod and of the cap are opposed to one another, so that on making contact under the action of the opposing spring, a turning torque is produced which tends to rotate the rod to a radial rotation abutment position, which occurs simultaneously with the positioning of one or more radial protuberances of said portion of the rod within complementary grooves provided in the inner face of the cap and in a position adjacent to the corresponding ramps thereof, so that in said rotation position the rod cannot move axially when the protuberances mentioned have entered the corresponding grooves that have been mentioned. In this way, a position is obtained in which it is not possible to displace the movable rod axially, and therefore it is not possible to cause the product contained in the container to be discharged. That is to say, this is a safety position in which the metering valve cannot function, and therefore the uncontrolled discharge of product cannot occur. To obtain normal metering working of the valve, it is sufficient to rotate slightly the upper end of the closure cap or of the actual pouring spout to release the protuberances of the displaceable rod with respect to the inner grooves of the cap, permitting the axial displacement of the rod which causes the product being metered to be discharged. Owing to the helical shape of the ramps which are disposed in opposition between the displaceable rod and the cap, on the return of the rod after an actuation cycle by the action of the opposing spring, the turning torque of the rod will be produced which will bring it to the abutment position which has been explained. That is to say, it will be disposed automatically in the locked position, so that uncontrolled actuation of the valve cannot take place.

For better understanding thereof, some drawings of a preferred embodiment of the present invention are appended by way of non-limiting example.

Figure 1:
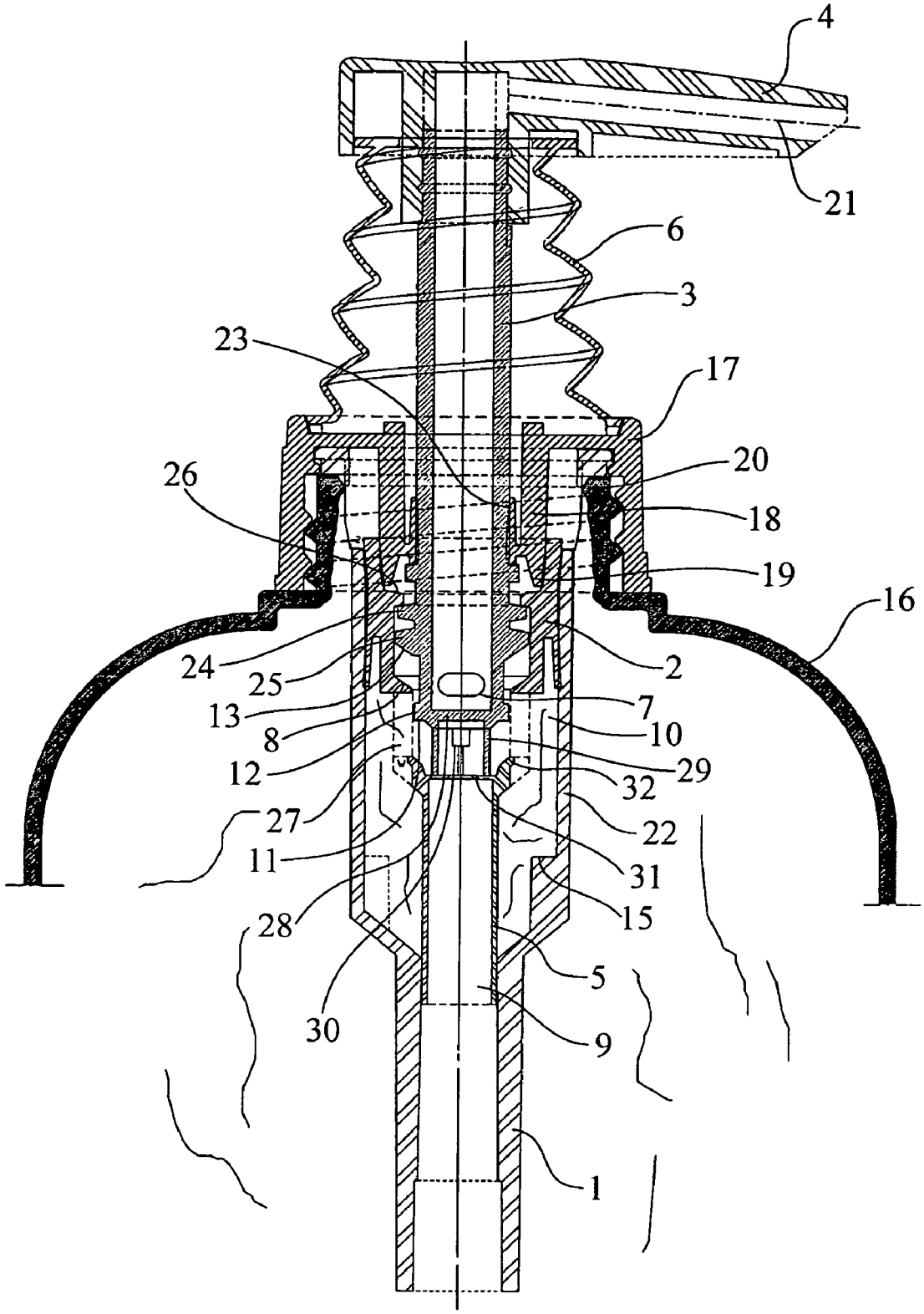
FIGS. 1, 2, 3 and 4 show respective cross-sections of the device of the present invention, from the initial closure position with the seal unbroken, to the position for re-filling of which the intermediate chamber after having executed a product expulsion cycle and having reached the abutment in the expulsion stroke.

As can be observed in the drawings, the valve device with built-in pump is coupled to a container 16 which carries the product to be metered and which has mounted at the top on its neck 20 a closure cap 17 coupled to the neck 20 of said container and having internally a coaxial cylindrical sleeve 18 provided with a lower flange 19.

The metering valve/propulsion pump device comprises three concentric parts indicated respectively by the numerals 1, 2 and 3, and fitted into one another in a manner which will be explained. The part 3 constitutes the hollow rod which is incorporated in the metering handle/nozzle 4 which has the axial passage 21 for the discharge of the product, as is known in this art. A spring or bellows device, indicated by the numeral 6, is connected between the upper portion of the closure cap 17 and the metering handle/nozzle assembly 4 for the recovery of the closure position of the device which is shown in FIG. 1.

The part 1 has a generally cylindrical shape with two bodies of different diameter, the upper portion having the larger diameter and being indicated by the numeral 22, and the lower portion 5 being of smaller diameter, hollow internally according to the chamber indicated by the numeral 9 and fitting inside the portion of smaller diameter of the first part or outer part 1, which is fixed by its upper end between the closure cap 17 and the upper rim of the neck 18.

Between the second part, especially the narrower portion 5 and the inner portion of larger diameter 22 of the part 1, there is formed the intermediate chamber 10 in which the product is deposited after a suction cycle produced by the rise of the part 3 brought about by the recovery device 6, as will be explained in more detail hereinafter.

Figure 2:
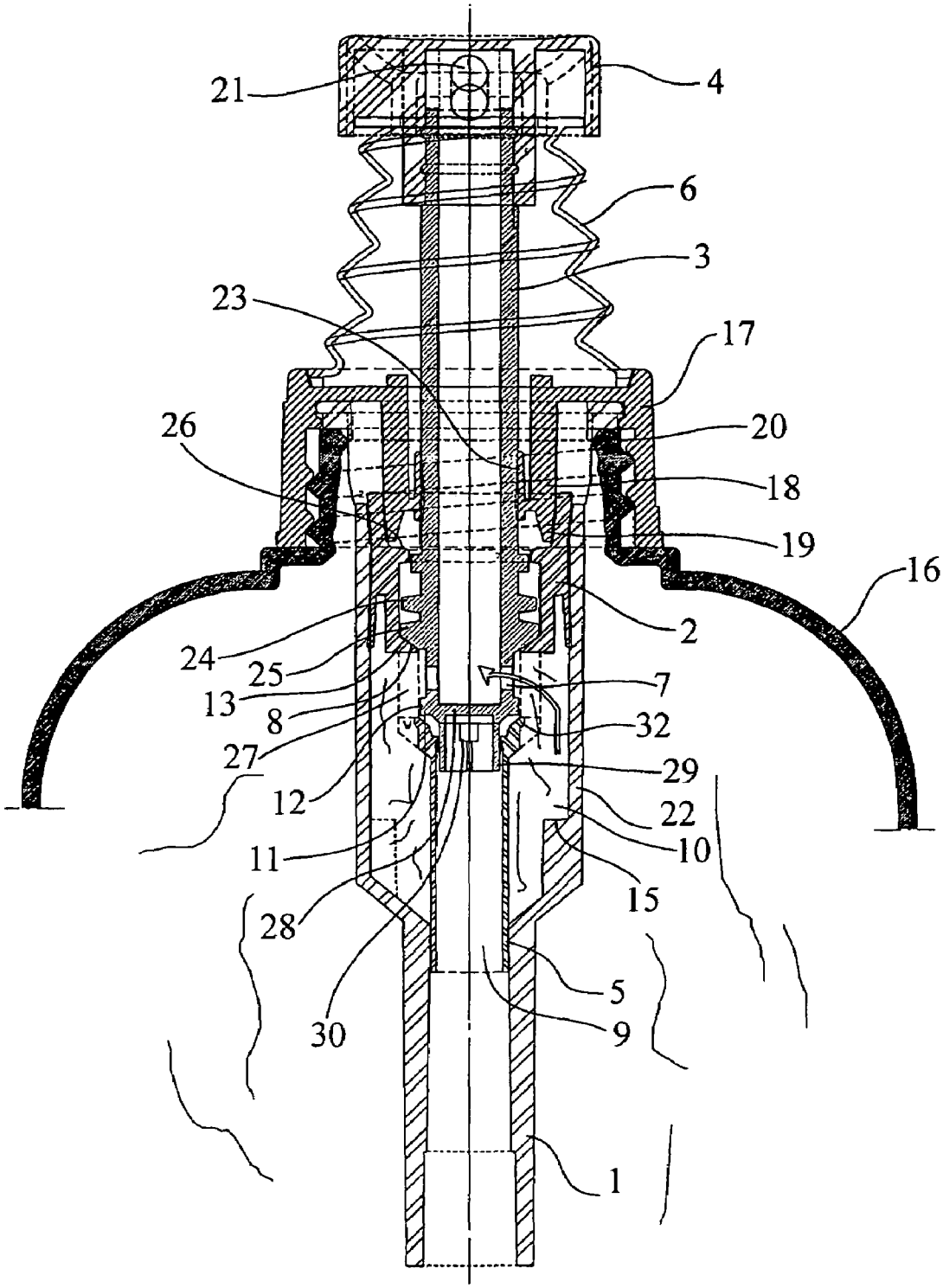
Figure 3:
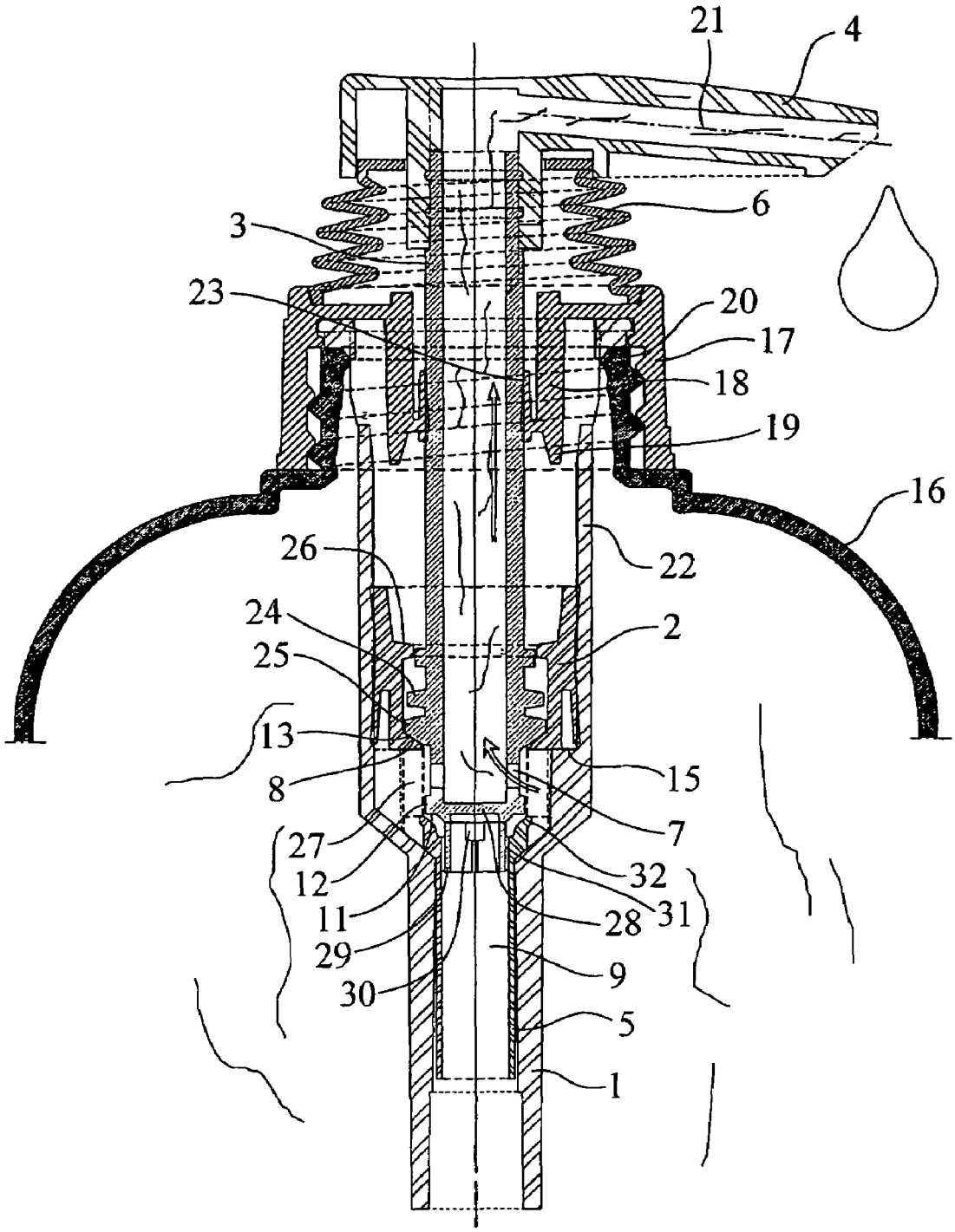
Figure 4:
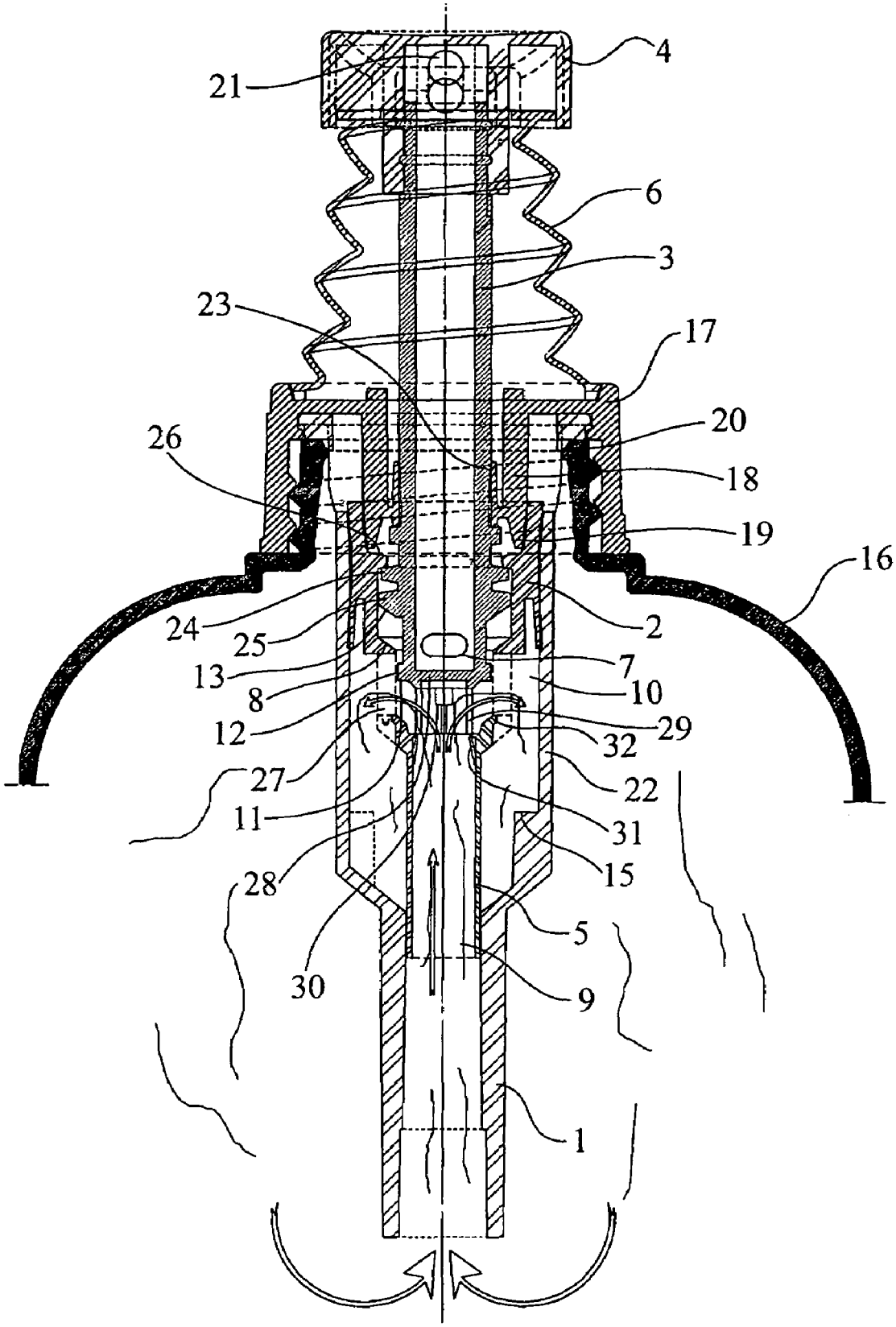
Figure 5:
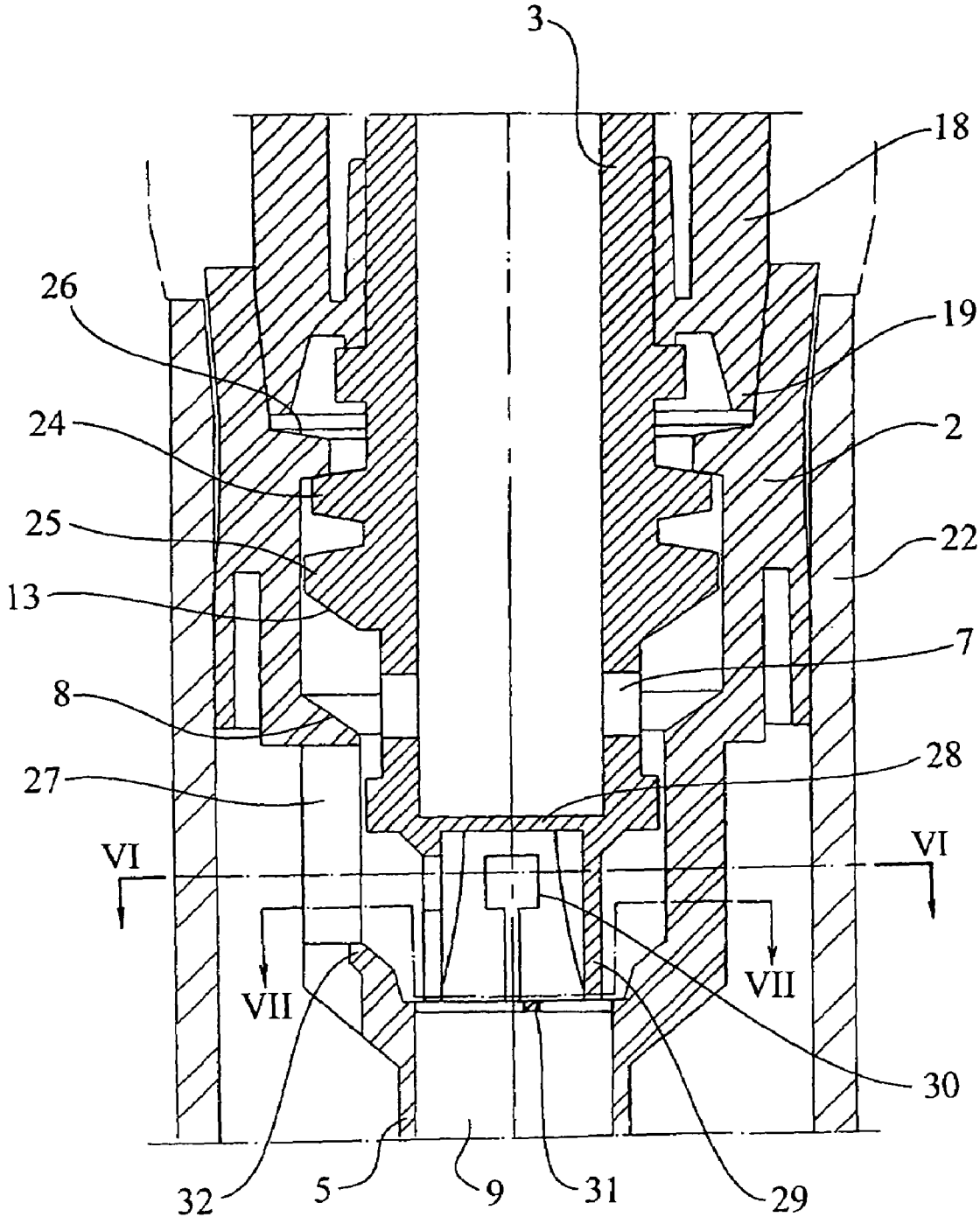
FIG. 5 shows a detail in section of the assembly of valves of the present invention.
Figure 6:
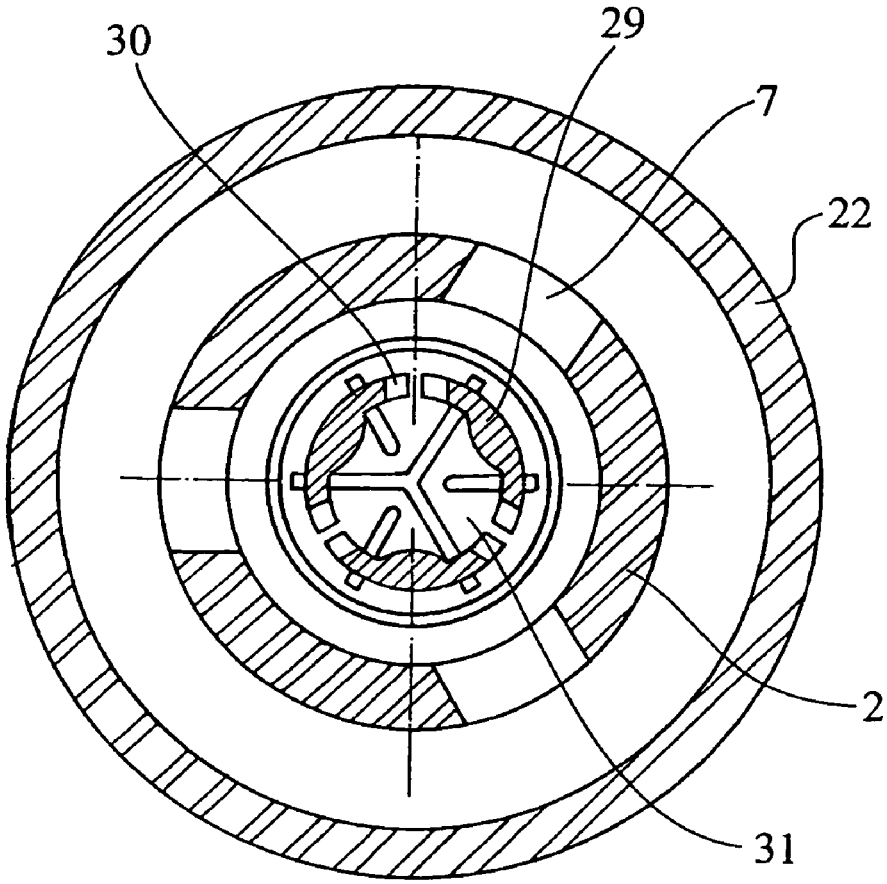
FIGS. 6 and 7 are respective cross sections through section planes indicated.
Figure 7:
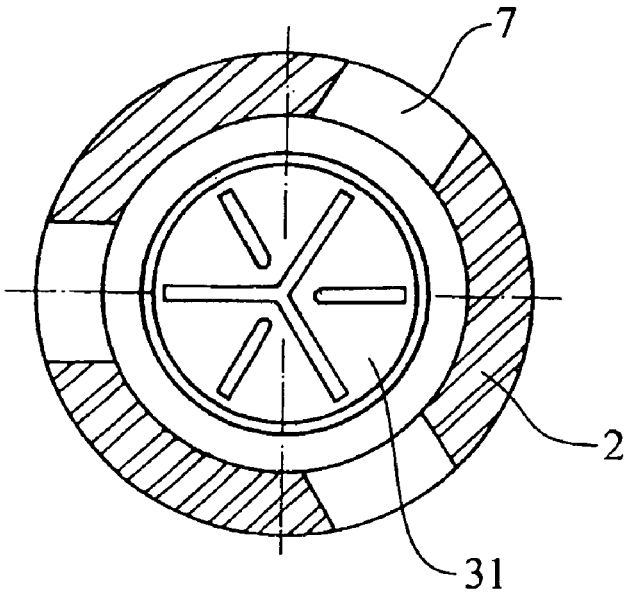
Figure 8:
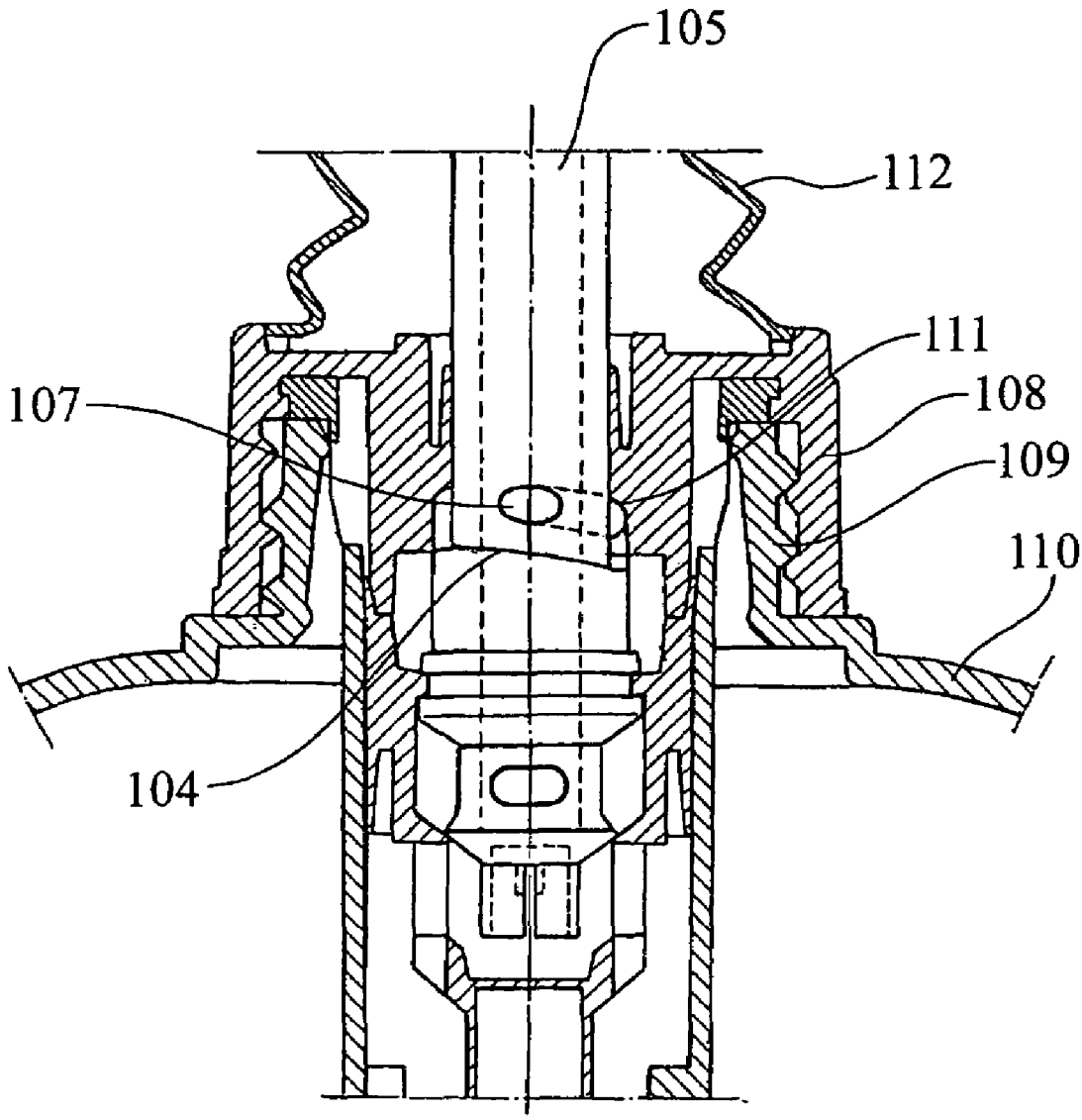
FIG. 8 shows a section representing the members of the metering valve in a locked position thereof, that is to say, in the position in which axial displacement is not possible.
Figure 9:
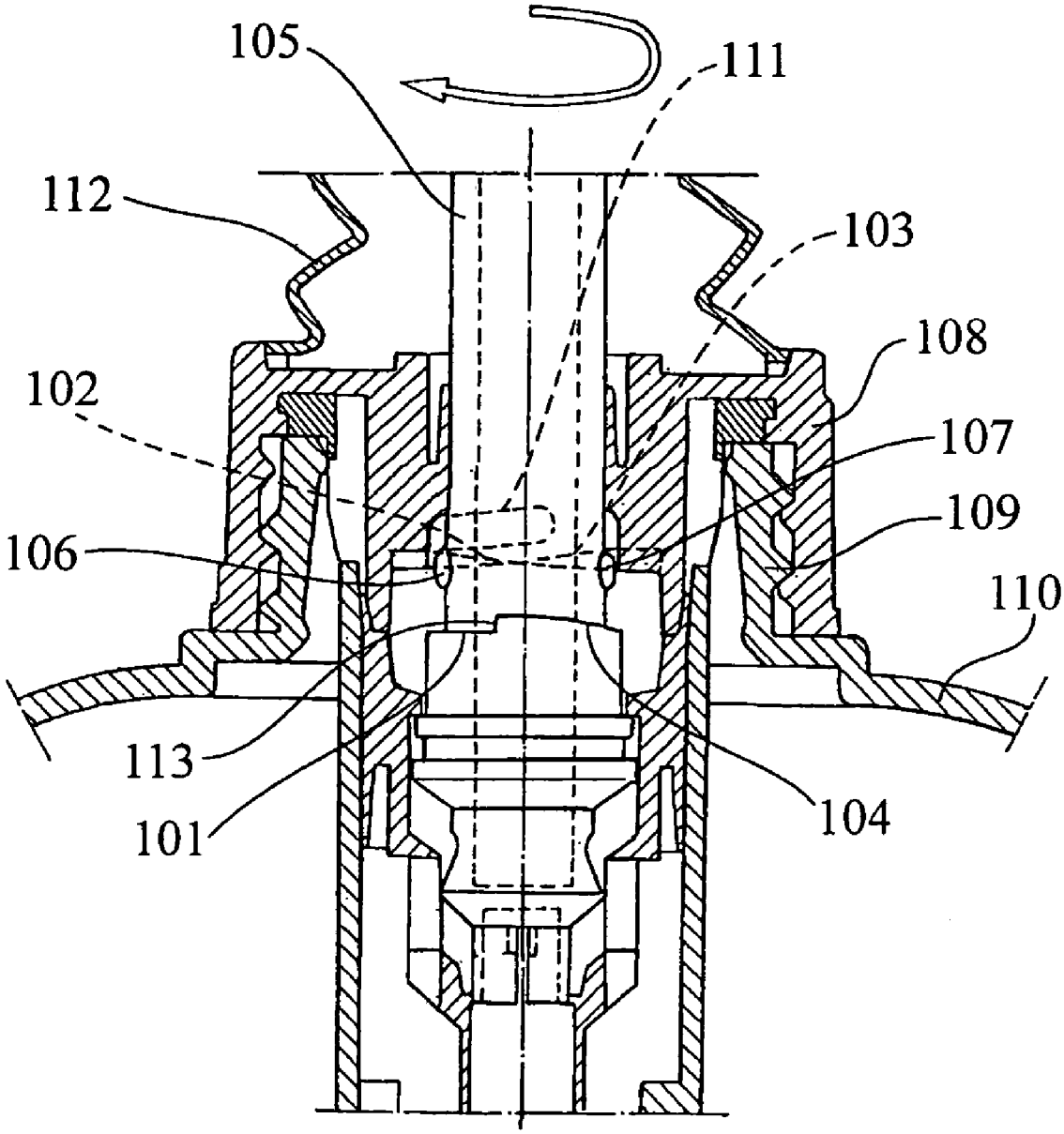
FIG. 9 is a view similar to FIG. 8 in which the release position can be seen, that is to say, the position in which the displacement of the axial rod of the valve can take place.
Figure 10:
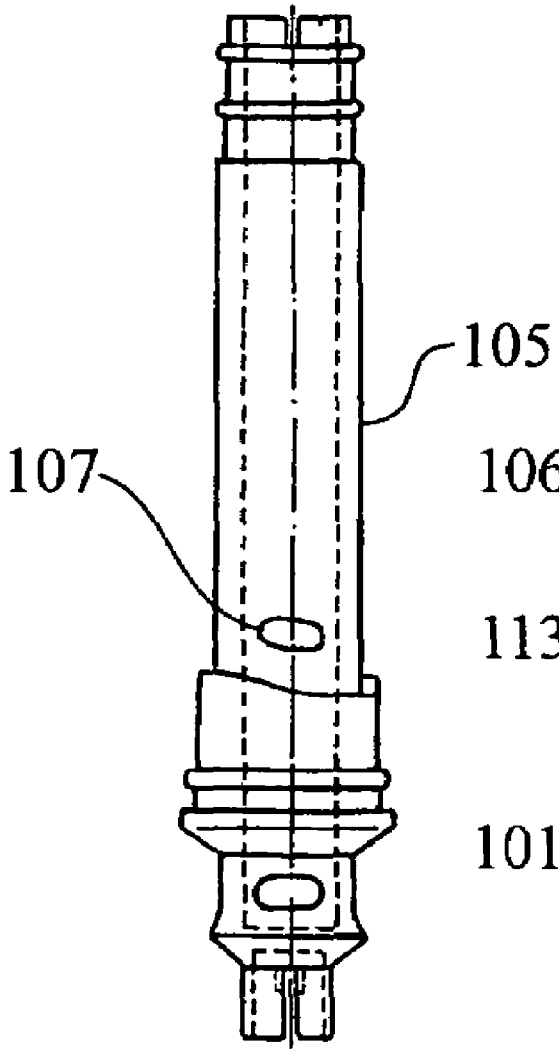
FIGS. 10 and 11 show respective views of the axially displaceable rod in order for the specific embodiment thereof to be seen.

The third part constituting the hollow rod 3 coupled to the metering handle/nozzle 21 slides in a cylindrical sleeve 23 with which the closure cap 17 is provided internally, and has two peripheral ribs 24 and 25 which slide inside the second part 2 in the upper portion thereof which constitutes the main plunger of the device. Respective inner projections of said part 2, indicated by the numerals 26 and 8, act as abutments for the sliding of the part 3. When said part 3 is in the abutment position indicated in FIG. 1, with the rib 24 making contact with the projection 26, the closure position of the valve is obtained, whereas when the rib 25 abuts the projection 8, as can be observed in FIGS. 2 and 3, the position is obtained in which the plunger 2 is entrained by the downward movement of the hollow rod 3, this corresponding, as will be explained hereinafter, to the cycle of propulsion of the product from the intermediate chamber 10 to bring about its discharge through the vents 27 of the intermediate portion of the second part of the device, between the plunger 2 and the end of smaller diameter 5 and the vents 7 of the upper portion of the hollow rod 3 which is closed at the bottom by a partition wall 28.

The part 3 carries at its end, below the partition wall 28, a small hollow cylindrical extension 29 provided in its turn with upper vents 30 and which is capable of engaging the small transverse safety partition wall 31 arranged at the start of the portion of smaller diameter 9.

The part 3 provided with the hollow rod further has in a position adjacent to the intermediate partition wall 25 a cylindrical projection 12 and a lower seat 11 capable of mating with the upper edge 32, adjacent to the vents 27, of the second part of the device.

Figure 11:
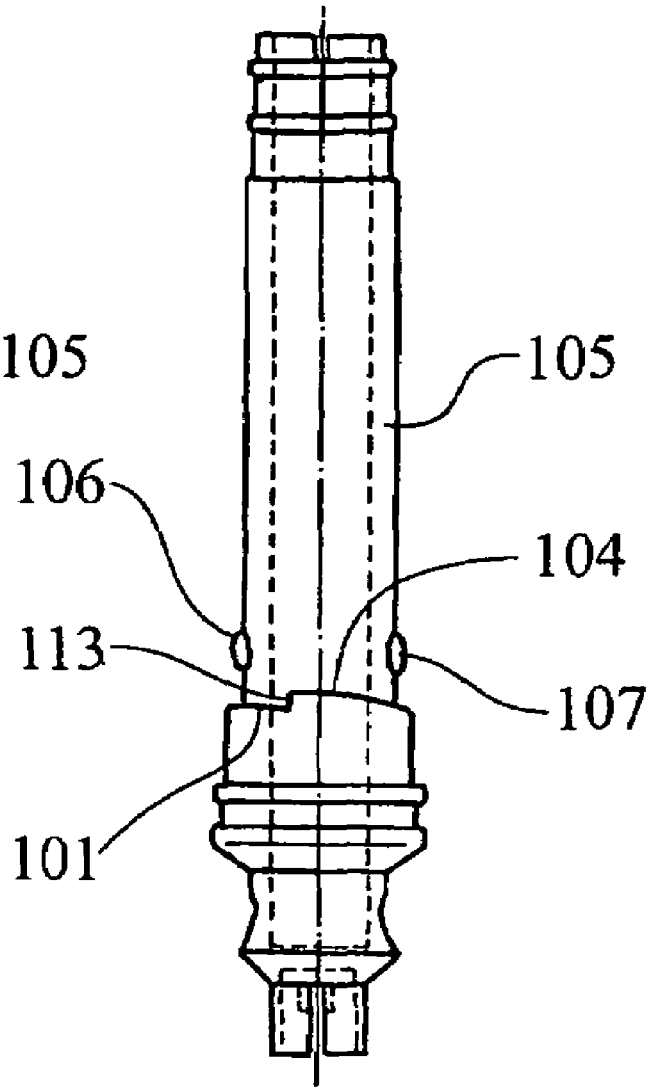

The embodiment in FIGS. 8 to 11 relates to the means for avoiding unintentional actuation, which comprise the provision of helical ramps, for example two in number, such as those indicated by the numbers 101 and 104 in FIG. 11, which project from the axial rod 105 which is intended to entrain the plunger portion. The rod itself has small radial protuberances 106 and 107, the functioning of which will be explained hereinafter.

The portion 108 incorporating the cap which is fixed in the neck 109 of the container 110 which contains the product to be metered, has the ramps 102 and 103 which are disposed in opposition to other ramps of complementary shape which the rod 105 has internally and which have been shown with the numbers 101 and 104 in the figures. At the same time, the cap has in its inner face two grooves, of which only the groove 111 has been shown in the figures, and on which the protuberances 106 and 107 can coincide when the rotation of the rod 105 on its own axis takes place.

With the arrangement of members explained, on the actuation of the opposing spring, which may be constituted by the bellows 112, or some other suitable member, in the recovery cycle after metering of the product, the ramps 101 and 104 will engage the mating ramps 102 and 103 of the cap, thereby producing a torque for turning the rod 105 until the ends of the ramps 101 and 104, for example the end 113 indicated in the figures, abut with the corresponding end of the mating ramps of the cap, limiting the rotation of the rod 105. In this position, the protuberances 106 and 107 will have entered the respective inner grooves of the cap, such as, for example, the groove 111 which has been shown, therefore preventing the axial displacement of the rod 105, that is to say, corresponding to the locked position.

To unlock the device, it is sufficient to bring about a slight rotation on the upper end of the rod 105, for example by means of the actual pouring spout or cap of the metering device, so that the protuberances 106 and 107 emerge from inside the grooves 111 of the cap, permitting normal displacement thereof. At the end of a metering cycle, and by means of the mechanism explained previously, the rod will pass automatically to the locked position, not being able, therefore, to effect any uncontrolled supply of product.

As will be understood, the shape and number of the ramps, and also of the protuberances 106 and 107 themselves, may vary within wide limits without departing from the scope of the present invention. Thus, for example, the protuberances 106 and 107 may have a slightly helical shape, such as has been shown, or may have an entry chamfer or the like to improve the characteristics of automatic entry into the abutment position. Likewise, the number of ramps in the rod and in the cap may vary from a minimum of one to a maximum limited solely by practical considerations of manufacture of the injection moulds.

The invention claimed is:

1. A metering valve for dispensing a substance from a container that includes a nozzle that is actuated by compression to dispense the substance from the container, the nozzle being automatically returned to a rest position by means of a resilient member that is coupled between the nozzle and the container, the metering valve comprising:

an assembly of first, second and third coaxial cylindrical parts;

wherein the first part has an upper section and a lower section that has a diameter less than a diameter of the upper section, the upper section including a collar for placement between an upper rim of a neck of the container and a cap that closes a container opening defined by the neck resulting in the first part being fixed with respect to the container;

wherein the second part is disposed within an interior of the first part and has an upper portion of increased diameter relative to a lower portion thereof, the upper portion being configured to function as a plunger and slidingly travel along the upper section of the first part, the second part having vents formed therein in an intermediate portion between the upper and lower portions thereof, the lower portion of reduced diameter being received and guided within an interior of the lower section of the first part, the upper portion that functions as the plunger having an inner cylindrical projection, wherein an inner chamber is defined between facing surfaces of the first and second parts;

wherein the third part includes a hollow cylindrical rod that is attached at its upper end to the nozzle such that an axial opening extending through the rod is in communication with a passage formed in the nozzle for dispensing a dose of the substance, the rod having a lower end section for placement inside the container, the lower end section having a reduced diameter relative to an upper end section that terminates in the upper end, the rod having a pair of outwardly extending peripheral ribs proximate its lower end for defining contact positions with respect to the inner cylindrical projection of the second part, the rod having vents formed proximate a location where the lower end section begins, the vent being configured for passage of the substance from the inner chamber towards the axial opening of the third part for dispensing through the nozzle;

wherein filling of the inner chamber with the substance is effected by recovery movement of the subassembly defined by the second and third parts which are axially movable relative to the container while the first part is fixed, the recovery movement being produced by the resilient member, the substance to be metered entering through the vents of the second part and the aligned vents of the third part during actuation of the metering valve assembly; and wherein the rod of the third part includes an arrangement of protruding helical ramps that are axially displaceable by applying a force to the metering valve, the helical ramps being arranged opposite complementary shaped fixed ramps that are formed on an inner surface of the cap, the rod further having protuberances located above the helical ramps and the inner surface of the cap further includes complementary grooves in which the protuberances can coincide for rotation thereof which corresponds to a coupling rotation of the opposing ramps of the rod and cap so tat return of the rod after a metering cycle by action of the resilient member has the effect of automatic rotation of the rod itself when the helical ramps impinge on the fixed ramps of the cap and the protuberances coinciding simultaneously within the grooves of the cap to signify a safety abutment position in which the metering valve cannot be actuated without positive rotation of the rod by moving the nozzle.

2. The metering valve of claim 1, further including a safety sealing partition wall that closes an entrance into the lower portion, wherein in an initial sealed position, the lower end section of third part is disposed proximate the intact sealing partition wall, the sealing partition wall being constructed so at to be rupturable by the lower end section upon a first axial actuation of the nozzle, thereby providing a tamper-evident seal of the substance in the container.

3. The metering valve of claim 1, wherein a lower portion of the upper section of the first part includes inwardly extending steps that serve as an axial stop for the upper portion of the second part and limits axial movement of the second part in a direction toward the lower section of the first part.

4. The metering valve of claim 1, wherein the pair of peripheral ribs of the rod is defined by a first upper peripheral rib and a second lower peripheral rib and the upper portion of the second part has first and second inwardly extending annular projections received between the first upper peripheral rib and a second lower peripheral rib, the first projection contacting the first upper peripheral rib to define an upper axial abutment position and the second projection contacting the second lower peripheral rib to define a position for downward entrainment between the second and third parts.

5. The metering valve of claim 1, wherein the lower end section of the third part includes vents.

6. The metering valve of claim 1, wherein the first part includes an internal partition wall formed between the upper end section and the lower end section of lesser diameter compared to the upper end section, the internal partition wall separating the upper end section, through which the substance is delivered to the nozzle, from the lower end section.

7. The metering valve of claim 1, wherein the third part includes an external rib at a lower end of the upper end section that is configured to abut an edge formed in the intermediate portion of the second part to limit axial travel.

8. The metering valve of claim 1, wherein the cap which is fixed to the neck of the container includes an outer sleeve and an inner sleeve that are coaxial to one another, the outer sleeve receiving the upper portion of the second part and having a lower edge that abuts against the second part for limiting axial travel thereof, the inner sleeve being formed internal to the outer sleeve and configured to receive the upper end section of the third part such that the upper end section can slidingly travel therein in an axial manner.

9. The metering valve of claim 1, wherein ends of the respective ramps of the rod and cap form an abutment for the rotation of the rod on its axis.

10. The metering valve of claim 1, wherein the protuberances of the rod have entry chamfers to improve their self-centering.

11. The metering valve of claim 1, wherein the protuberances have a helical shape.

* * * * *